US005186373A

United States Patent [19]

Taylor

[11] Patent Number: 5,186,373

[45] Date of Patent: Feb. 16, 1993

[54] CONNECTOR ASSEMBLY FOR REMOVABLY HOLDING A GLOVE

[76] Inventor: John T. Taylor, 10805 Dorothy Dr., Oklahoma City, Okla. 73162

[21] Appl. No.: 791,823

[22] Filed: Nov. 13, 1991

[51] Int. Cl.[5] ..... A45F 5/00

[52] U.S. Cl. ..... 224/183; 224/230; 224/901; 24/303; 24/306

[58] Field of Search ..... 224/183, 230, 194, 101, 224/901, 918; 24/303, 306; 248/683, 206.5

[56] References Cited

U.S. PATENT DOCUMENTS 3,051,130 8/1962 Morris .
3,321,119 5/1967 D'Andrea .
3,374,508 3/1968 Slimovitz ..... 24/306
3,741,376 6/1973 Brown .
4,498,615 2/1985 Johnson .
4,625,862 12/1986 Clayton .
4,779,655 10/1988 Olson .
4,882,787 11/1989 Hull .
5,031,812 7/1991 Gustine .

*Primary Examiner*—Linda J. Sholl
*Attorney, Agent, or Firm*—Dunlap, Codding & Lee

[57] ABSTRACT

A connector assembly for removably holding a glove where the glove has a glove attachment device connected thereto. The connector assembly includes a holder which is foldable at a fold position. A first permanent magnet is connected to one portion of the holder and a second permanent magnet is connected to another portion of the holder. A holder attachment device is connected to the holder. A portion of the holder is removably disposed in a pocket and another portion of the folder extends over a pocket flap and position so that the first and the second permanent magnets are magnetically connected to magnetically connect the holder to the pocket. The glove attachment device is removably connectable to the holder attachment device for removably connecting the glove to the holder.

12 Claims, 2 Drawing Sheets

CONNECTOR ASSEMBLY FOR REMOVABLY HOLDING A GLOVE

BACKGROUND OF THE INVENTION

Field of the Invention

The present invention relates to a holder having a holder attachment means and which is connectable to a pocket via permanent magnets and wherein a glove attachment means of a glove is removably connectable to the holder attachment means for removably connecting the glove to the holder.

DESCRIPTION OF THE PREFERRED EMBODIMENTS

In many instances, an individual is required to wear a glove vary certain aspects of a particular activity. When those particular aspects are completed, the individual generally removes the glove. Then, where to conveniently and temporarily store the glove becomes a problem.

For example, in playing golf, the individual typically wears a golf glove for gripping a golf club while making certain shots. The individual, after making the shot, then removes the glove. In this instance, the individual generally sticks a portion of the glove in the individual's back pocket or attaches the golf glove to a golf bag or otherwise temporarily stores the golf glove until needed again in connection with another golf shot. Also, for example, in playing baseball, an individual typically wears a glove in certain instances, such as when batting. After completion of the activity, such as batting, the individual again typically temporarily stores the glove in the individual's back pocket by simply sticking a portion of the glove in the individual's back pocket.

The present invention particularly is adapted to provide a means for removably holding a glove such as a golf glove when the individual is not wearing the glove.

Figure 2:
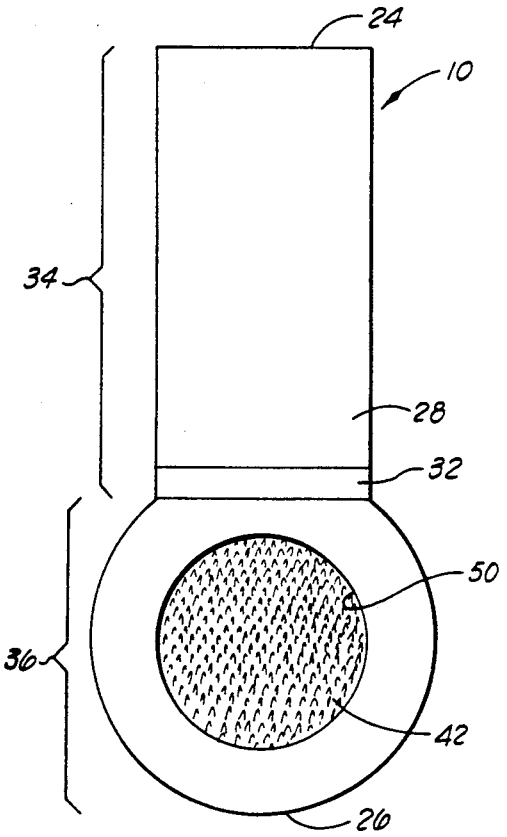
FIG. 2 is a plan view of the assembled holder showing the upper surface of the holder.
Figure 3:
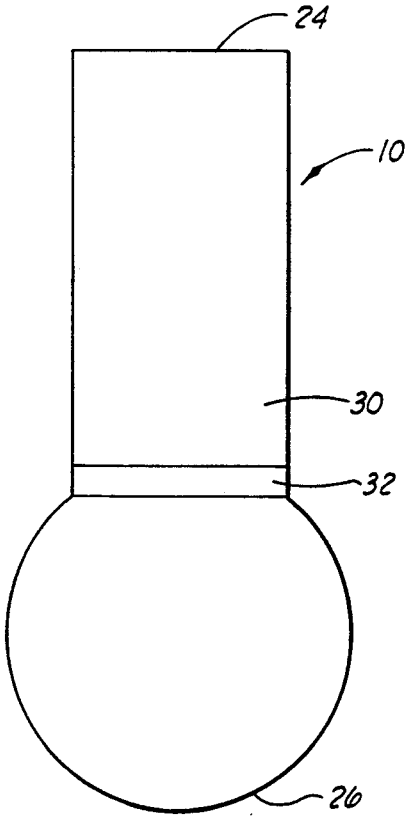
FIG. 3 is a plan view of the holder of FIG. 1, but showing the lower surface of the holder.

As shown in FIGS. 2 and 3, the present invention comprises a holder 10. The holder 10 is adapted to removably hold a glove (a typical glove being shown in FIG. 4 and designated therein by the reference numeral 12) with the glove 12 having an attachment means or device 14 connected thereto such as a hook and loop attachment means like Velcro ® for example.

The attachment means 14 on the glove 12 generally is used to secure the glove 12 about the wrist of the individual after the glove 12 has been placed on the individual's hand.

Figure 4:
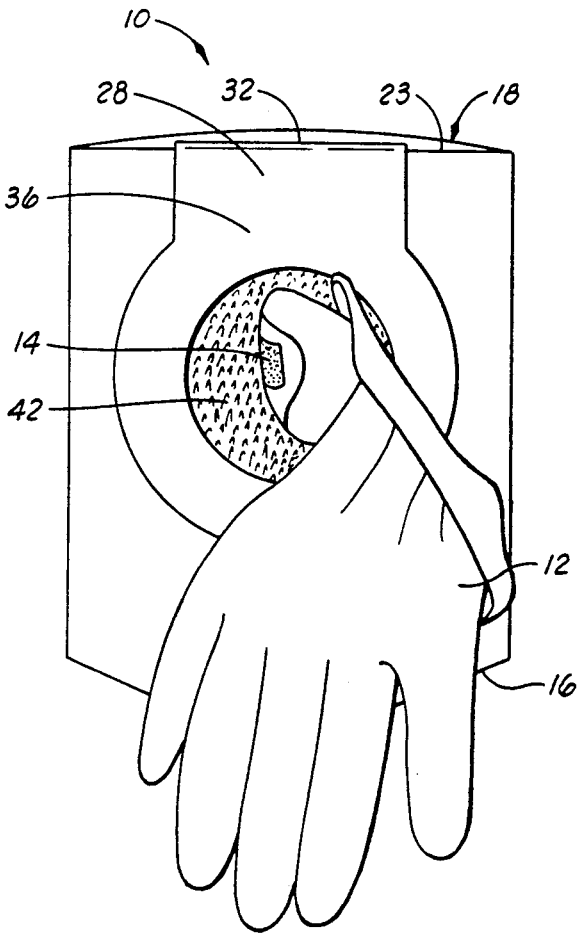
FIG. 4 is a diagrammatic view showing a portion of a pocket with the holder of the present invention removably connected to a pocket flap attached to the holder.

The holder 10 is removably connectable to a pocket flap 16 of a pocket 18 (FIG. 4) on clothing such as the individual's pants with the pocket 18 being one of the rear pockets on the individual's pants for example. The pocket flap 16 has an outside surface 20 (FIG. 5), an inside surface 22 (FIG. 5) and a pocket side 23 (FIGS. 4 and 5).

In operation, a portion of the holder lo is disposed inside the pocket 18 generally adjacent the inside surface 22 and another portion of the holder 10 is disposed on the outside of the pocket 18 generally adjacent the outside surface 22. The two portions of the holder 10 are magnetically connected to secure the holder 10 to the pocket flap 16. In this position of the holder 10, the glove attachment means 14 is removably connectable to a portion of the holder 10 for removably securing or holding the glove 12 on the holder 10 connected to the pocket 18.

As more clearly shown in FIGS. 2 and 3, the holder 10 includes a first end 24 and a second end 26. The holder 10 also has an upper surface 28 (FIGS. 2, 4 and 5) and a lower surface 30 (FIGS. 3 and 5). The holder 10 is foldable at a fold position 32 (FIGS. 2, 3, 4 and 5) disposed between the first and the second ends 24 and 26 of the holder 10. The fold position 32 forms a first holder portion 34 (FIGS. 2 and 5) extending between the first end 24 and the fold position 32 and a second holder portion 36 (FIGS. 2, 4 and 5) extending between the fold position 32 and the second end 26 of the holder 10.

Figure 1:
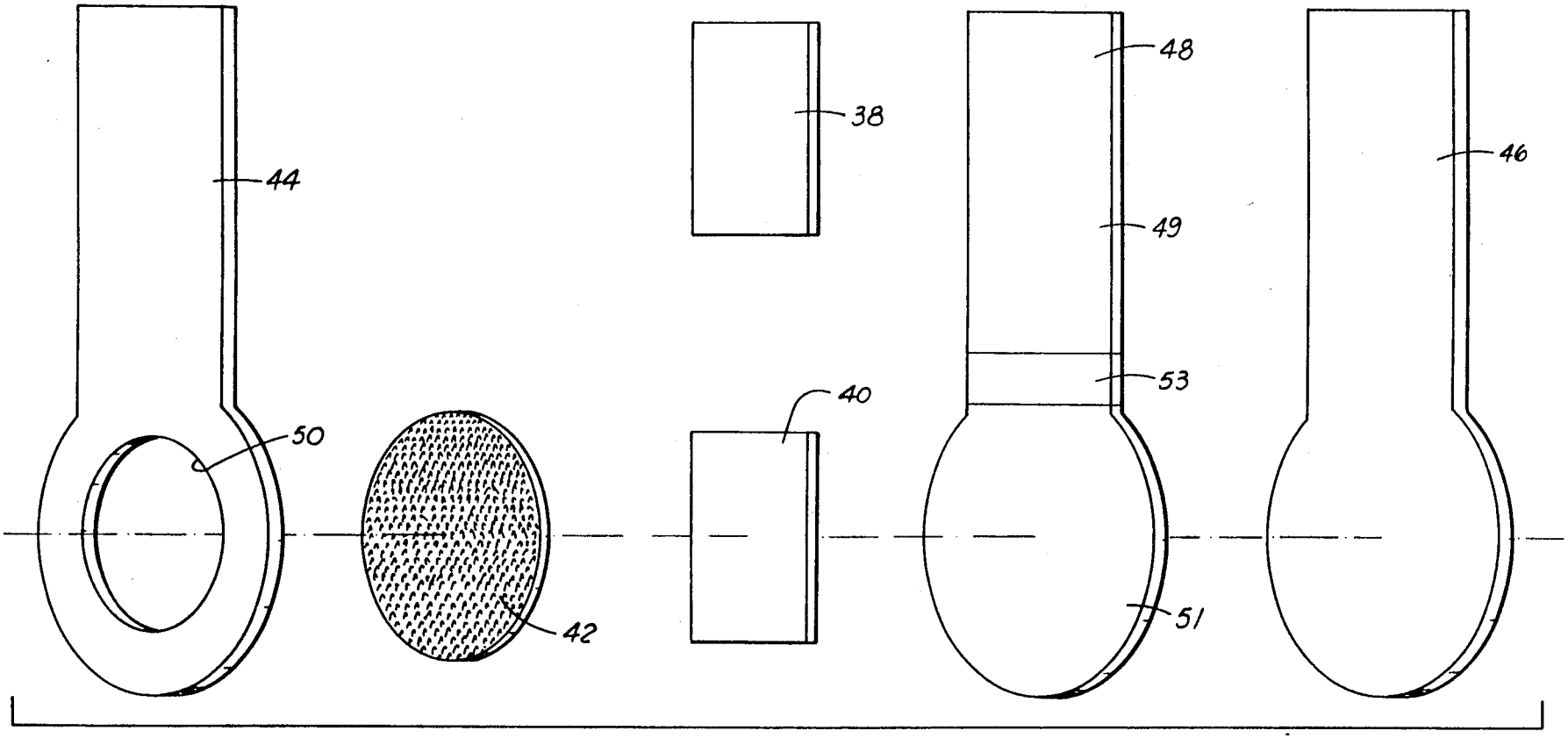
FIG. 1 is an exploded view illustrating the construction of a holder constructed in accordance with the present invention.
Figure 5:
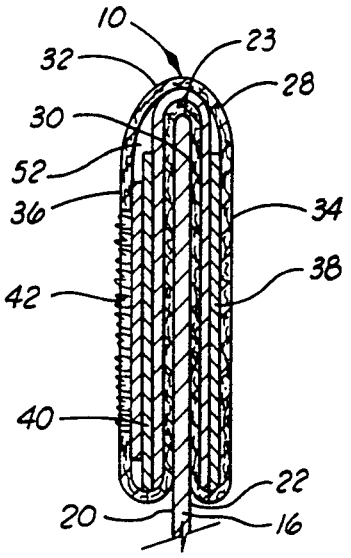
FIG. 5 is a sectional view of the holder of the present invention removably connected to a pocket flap (a portion of the pocket flap being shown in FIG. 5 in section).

A first permanent magnet 38 shown in FIGS. 1 and 5 is connected to the holder 10 and positioned in the first holder portion 34 of the holder 10. A second permanent magnet 40 (FIGS. 1 and 5) is connected to the holder 10 and positioned in the second holder portion 36 of the holder 10.

A holder attachment means 42 (FIGS. 1, 2, 4 and 5) is connected to the holder 10 and positioned in the second holder portion 36 of the holder 10. The holder attachment means 42 is positioned on the holder 10 such that the holder attachment means 42 is accessible via the upper surface 28 of the holder 10. The holder attachment means 42 is preferably a hook and loop attachment means such as Velcro ® for example.

The first holder portion 34 is generally rectangularly shaped in plan view. The second holder portion 36 is generally circularly shaped in plan view. The first holder portion 34 extends a distance from the second holder portion 36.

In one preferred form and as illustrated in FIG. 1, the holder 10 is constructed from a first panel 44 and a second panel 46. The first and the second panels 44 and 46 each have a shape which is substantially identical to the shape of the overall holder 10.

The holder 10 also includes a stiffener insert 48 which also has a shape substantially corresponding to the overall shape of the holder 10.

The holder insert 48 includes a first stiffener section 49 and a second stiffener section 51. The first stiffener section 49 is rectangularly shaped and the shape of the first stiffener section 49 basically corresponds to the shape of the first holder portion 34. The second stiffener section 51 is circularly shaped and has a shape which basically corresponds to the shape of the second holder portion 36. The stiffener insert 48 also includes a flexible section 53 which connects the first stiffener section 49 to the second stiffener section 51. The flexible section 53 may be constructed of any flexible material such as leather for example. The flexible section 53 facilitates the folding of the first holder portion 34 over the second holder portion 36 in a manner and for reasons to be made more apparent below.

In one preferred form, the first and the second panels 44 and 46 each are constructed of a relatively flexible material such as leather for example and the stiffener insert 48 is constructed of a relatively stiff, yet flexible material such as cardboard for example. The stiffener insert 48 provides stiffness to the first and the second panels 44 and 46 when connected together to form the holder 10 so that the first and the second panels 44 and 46 retain the shape of the holder 10.

A circularly shaped opening 50 (FIGS. 1 and 2) is formed through the first panel 44. The holder attachment means 42 is disposed over the opening 50 and connected to the first panel 44 by stitching or gluing with the holder attachment means 42 substantially encompassing the opening 50. The second permanent magnet 40 is disposed over the holder attachment means 42 and secured to the first panel 44 such as by gluing the second permanent magnet 40 to the first panel 44 for example. The second permanent magnet 38 is secured to the inside surface of the front panel 44 such as by gluing the first permanent magnet 38 to the inside surface of the first panel 44.

In this position, the stiffener insert 48 is disposed over the inside surface of the first panel 44 and the second panel 46 is disposed over the stiffener insert 48. In this position of the first and the second panels 44 and 46 and the stiffener insert 48, the first panel 44 is secured to the second panel 46 such as by stitchingly connecting the first panel 44 to the second panel 46 with the stitching extending generally about the outer peripheral edges of the first and the second panels 44 and 46.

The first and the second panels 44 and 46 form a component space 52 (FIG. 5) which extends between the first and the second panels 44 and 46 when the first and the second panels 44 and 46 are connected together to form the holder 10. The holder attachment means 42 and the first and the second permanent magnets 38 and 40 each are disposed in the component space 52 of the assembled holder 10.

In operation and as illustrated in FIGS. 4 and 5, the first holder portion 34 is disposed in the pocket 18 with the lower surface 30 portion of the first holder portion 36 being disposed generally adjacent the inside surface 22 of the pocket flap 16. In this position, the holder 10 is folded at the fold position 32 for folding the second holder portion 36 to a position wherein the lower surface 30 portion of the second holder portion 36 extends along the pocket flap 18 with the inside surface 30 portion of the second holder portion 30 being disposed adjacent the outside surface 20 of the pocket flap 16. In this position, the first holder portion 34 is disposed inside the pocket 18 and a second holder portion 36 is disposed outside the pocket 18 with the first holder portion 34 being aligned with the second holder portion 36. More particularly, in this position wherein the holder 10 is removably connected to the pocket 18, the first permanent magnet 38 in the first holder portion 34 is aligned with the second permanent magnet 40 with a portion of the pocket flap 16 being disposed between the first and the second permanent magnets 38 and 40. The first permanent magnet 38 is magnetically attracted to and connected to the second permanent magnet 40 with the pocket flap 16 being disposed therebetween thereby removably connecting the first holder portion 34 to the second holder portion 36 for removably connecting the holder 10 to the pocket flap 16.

After the holder 10 has been removably connected to the pocket flap 16, the holder attachment means 42 is accessible from outside the pocket 18. The individual then presses the glove attachment means 14 on the holder attachment means 42 thereby removably connecting the glove attachment means 14 to the holder attachment 42 for removably connecting the glove 12 to the holder 10.

Changes may be made in the construction and the operation of the various components, elements and assemblies described herein without departing from the spirit and scope of the invention as defined in the following claims.

What is claimed is:

1. A connector assembly for removably holding a glove having a glove attachment means connected thereto wherein the connector assembly is removably connectable to a pocket flap of a pocket on clothing, the pocket flap having an outside surface, an inside surface and a pocket side, the connector assembly comprising:

a holder having a first end, a second end, an upper surface and a lower surface, the holder being foldable at a fold position between the first and the second ends of the holder forming a first holder portion extending from the first end of the holder to the fold position and a second holder portion extending from the second end of the holder to the fold position;

a first permanent magnet connected to the holder and positioned in the first holder portion of the holder;

a second permanent magnet connected to the holder and positioned in the second holder portion; and holder attachment means connected to the holder and positioned in the second holder portion of the holder, the holder attachment means being accessible via the upper surface of the holder, the first holder portion of the holder being disposable in the pocket with the lower surface of the first holder portion being disposed adjacent the inside surface of the pocket flap and the holder being foldable at the fold position with the second holder portion extending along the pocket flap with the inside surface of the second holder portion being disposed adjacent the outside surface of the pocket flap, the first permanent magnet being aligned with the second permanent magnet when the holder is folded over the pocket flap and the first permanent magnet being disposed adjacent the second permanent magnet with the pocket flap being disposed therebetween when the holder is folded over the pocket flap, the first permanent magnet being magnetically connected to the second permanent magnet with the pocket flap disposed therebetween for removably connecting the holder to the pocket flap, the glove attachment means being removably connected to the holder attachment means for removably connecting the glove to the holder.

2. The connector assembly of claim 1 wherein the first holder portion is rectangularly shaped and the second holder portion is circularly shaped.

3. The connector assembly of claim 1 wherein the holder is defined further as having a component space formed therein disposed generally between the upper and the lower surfaces of the holder and extending generally between the first and the second ends of the holder, the first permanent magnet and the second permanent magnet and the holder attachment means being disposed in the component space.

4. The connector assembly of claim 3 wherein the holder is defined further to include an opening formed through the upper surface of the holder and positioned in the second holder portion, the holder attachment means being positioned over the opening and substantially encompassing the opening in the holder.

5. The connector assembly of claim 1 wherein the holder further comprises:

a first panel; and a second panel, the first panel being connected to the second panel with the component space being formed between the first and the second panels.

6. The connector assembly of claim 5 wherein the holder further comprises:

a stiffener insert, the stiffener insert being disposed between the first and the second panels for cooperating to hold the first and the second panels in the shape of the holder.

7. A connector assembly comprising:

a glove having a glove attachment means connected thereto;

a pocket formed on clothing comprising a pocket flap having an outside surface, an inside surface and a pocket side;

a holder having a first end, a second end, an upper surface and a lower surface, the holder being foldable at a fold position between the first and the second ends of the holder forming a first holder portion extending from the first end of the holder to the fold position and a second holder portion extending from the second end of the holder to the fold position;

a first permanent magnet connected to the holder and positioned in the first holder portion of the holder;

a second permanent magnet connected to the holder and positioned in the second holder portion; and holder attachment means connected to the holder and positioned in the second holder portion of the holder, the holder attachment means being accessible via the upper surface of the holder, the first holder portion of the holder being disposed in the pocket with the lower surface of the first holder portion being disposable adjacent the inside surface of the pocket flap and the holder being foldable at the fold position with the second holder portion extending along the pocket flap with the inside surface of the second holder portion being disposed adjacent the outside surface of the pocket flap, the first permanent magnet being aligned with the second permanent magnet when the holder is folded over the pocket flap and the first permanent magnet being disposed adjacent the second permanent magnet with the pocket flap being disposed therebetween when the holder is folded over the pocket flap, the first permanent magnet being magnetically connected to the second permanent magnet with the pocket flap disposed therebetween for removably connecting the holder to the pocket flap, the glove attachment means being removably connected to the holder attachment means for removably connecting the glove to the holder.

8. The connector assembly of claim 7 wherein the first holder portion is rectangularly shaped and the second holder portion is circularly shaped.

9. The connector assembly of claim 7 wherein the holder is defined further as having a component space formed therein disposed generally between the upper and the lower surfaces of the holder and extending generally between the first and the second ends of the holder, the first permanent magnet and the second permanent magnet and the holder attachment means being disposed in the component space.

10. The connector assembly of claim 9 wherein the holder is defined further to include an opening formed through the upper surface of the holder and positioned in the second holder portion, the holder attachment means being positioned over the opening and substantially encompassing the opening in the holder.

11. The connector assembly of claim 7 wherein the holder further comprises:

a first panel; and a second panel, the first panel being connected to the second panel with the component space being formed between the first and the second panels.

12. The connector assembly of claim 11 wherein the holder further comprises:

a stiffener insert, the stiffener insert being disposed between the first and the second panels for cooperating to hold the first and the second panels in the shape of the holder.

* * * * *

UNITED STATES PATENT AND TRADEMARK OFFICE

CERTIFICATE OF CORRECTION

PATENT NO. : 5,186,373

DATED : February 16, 1993

INVENTOR(S) : Taylor

It is certified that error appears in the above-identified patent and that said Letters Patent is hereby corrected as shown below:

Cover page, Abstract, line 11, please delete "position" and substitute therefor --positioned --.

Column 1, line 35, please delete "vary" and substitute therefor -- during --.

Column 2, line 6, please delete "lo" and substitute therefor -- 10 --.

Column 2, line 10, please delete "outside surface 22" and substitute therefor --outside surface 20--.

Column 3, line 22, please delete "second permanent magnet 38" and substitute therefor -- first permanent magnet 38 --.

Column 3, line 23, please delete "front panel 44" and substitute therefor -- first panel 44 --.

Column 3, lines 45-46, please delete "first holder portion 36" and substitute therefor -- first holder portion 34 --.

Column 3, line 51, please delete "pocket flap 18" and substitute therefor -- pocket flap 16 --.

Column 3, line 51, please delete "inside surface 30" and substitute therefor -- lower surface 30 --.

UNITED STATES PATENT AND TRADEMARK OFFICE

CERTIFICATE OF CORRECTION

PATENT NO. : 5,186,373

DATED : February 16, 1993

INVENTOR(S) : Taylor

It is certified that error appears in the above-identified patent and that said Letters Patent is hereby corrected as shown below:

Column 3, line 52, please delete "second holder portion 30" and substitute therefor -- second holder portion 36 --.

Signed and Sealed this

Thirtieth Day of May, 1995

Bruce Lehman

*Attest:*

BRUCE LEHMAN

*Attesting Officer*

*Commissioner of Patents and Trademarks*